US006782856B2

(12) United States Patent
Aimone

(10) Patent No.: US 6,782,856 B2
(45) Date of Patent: Aug. 31, 2004

(54) CAMSHAFT ACCUMULATOR

(75) Inventor: Michael George Aimone, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 343 days.

(21) Appl. No.: 10/063,297

(22) Filed: Apr. 9, 2002

(65) Prior Publication Data

US 2003/0188705 A1 Oct. 9, 2003

(51) Int. Cl.[7] ..... F01L 1/047
(52) U.S. Cl. ..... 123/90.34; 123/90.17
(58) Field of Search ..... 123/90.15, 90.17, 123/90.27, 90.34, 90.6, 196 R, 196 M; 74/567

(56) References Cited

U.S. PATENT DOCUMENTS

| | | | | | |
|---|---|---|---|---|---|
| 3,785,460 | A | | 1/1974 | Smith et al. | |
| 4,565,168 | A | | 1/1986 | Rivere | |
| 4,886,022 | A | * | 12/1989 | Nakai | 123/90.17 |
| 4,949,683 | A | | 8/1990 | Swars | |
| 5,144,921 | A | | 9/1992 | Clos et al. | |
| 5,228,841 | A | | 7/1993 | Kimura et al. | |
| 5,704,317 | A | * | 1/1998 | Barth | 123/90.17 |
| 5,937,812 | A | | 8/1999 | Reedy et al. | |
| 6,332,439 | B2 | * | 12/2001 | Sekiya et al. | 123/90.17 |
| 6,336,433 | B1 | * | 1/2002 | Anton et al. | 123/90.17 |
| 6,427,653 | B1 | * | 8/2002 | Hara et al. | 123/90.17 |
| 6,523,513 | B2 | * | 2/2003 | Speier | 123/90.17 |
| 2002/0148423 | A1 | * | 10/2002 | Speier | 123/90.17 |

* cited by examiner

*Primary Examiner*—Weilun Lo
(74) *Attorney, Agent, or Firm*—Dykema Gossett PLLC; Carlos L. Hanze

(57) ABSTRACT

An accumulator 114 is provided in an engine 7 camshaft 73 having at least one lobe and an internal cavity 170. A compliance member 174 is provided for pressurizing the fluid within the internal cavity 170.

12 Claims, 3 Drawing Sheets

CAMSHAFT ACCUMULATOR

BACKGROUND OF INVENTION

This invention relates to an automotive vehicle with an internal combustion engine having a camshaft with an accumulator.

Automotive vehicle engines with reciprocal pistons typically have a plurality of cylinder combustion chambers with the reciprocating pistons mounted therein. Each piston is pivotally connected with a piston rod, which is pivotally connected with a crankshaft. A timing gear is mounted at an end of the crankshaft. Typically, each cylinder has at least one intake valve and one exhaust valve. Both the intake valve and the exhaust valve are spring-loaded to a closed position. Each intake and exhaust valve is associated with a rocker arm. To operate the valves, the rocker arms are moved by a set of contacting cam lobes. The cam lobes are mounted on an elongated member known as a camshaft. Attached at an extreme end of the camshaft is a camshaft pulley. The camshaft pulley is powered by the crankshaft via a timing chain or belt which is looped over the camshaft pulley and a crankshaft timing gear. Accordingly, the camshaft is synchronized with the crankshaft and the timing of the opening and closing of the intake and exhaust valves is fixed with respect to the position of the piston within the cylinder combustion chamber.

In an effort to improve the environment by decreasing polluting emissions and increasing vehicle gas mileage, it has become desirable to allow the timing of the cylinder valve operation to vary with respect to the piston position within the cylinder chamber. To provide for the variable valve timing operation, a variable camshaft timing unit (VCT) is provided on the camshaft.

An example of a VCT is a dual oil feed vane-type VCT. A dual oil feed vane-type VCT provides an inner member or hub that is fixably connected to an end face of a camshaft. The hub has a series of vanes which are captured in cavities or pressure chambers provided in an outer member which is concentrically mounted on the hub. The outer member incorporates the camshaft timing pulley. The vanes circumferentially bifurcate the pressure chambers into an advance side and a retard side. A spool valve, fluidly communicative with the pressure chambers via the inner member and the camshaft, controls the fluid pressure in the advance side and retard side of the pressure chambers. Accordingly, the angular position of the timing pulley versus the crankshaft can be varied by controlling the fluid in the advance and retard pressure chambers.

Another example of a dual oil feed VCT is a helical gear type VCT. The helical gear type VCT has an outer member attached to an inner member or hub along a helical gear connection. A pressure chamber is provided between the inner and outer members. The pressure chamber is axially bifurcated by a pressure boundary which contacts the outer member to move the same with respect to the inner member. The outer member can axially move with respect to the inner member. The helical gear interconnection between the inner and outer members causes the outer member to rotate with respect to the inner member and accordingly changes angular position with respect to the inner member.

Both of the aforementioned VCTs utilize engine lubricating oil pressure and flow to phase the camshaft. The VCT must meet minimum phase speed requirements to achieve the desired fuel economy and emission benefits as well as acceptable drivability and the avoidance of stumble/stall conditions. Typically, the engine oil pump in most vehicles cannot meet the oil pressure instantaneous flow requirements of a VCT, especially at low engine speeds and high oil temperatures.

To meet the flow volume demand of engine arrangements having multiple VCTs, pressurized oil supply systems with an accumulator or accumulators have been proposed. Accumulators are well-known in the art and typically include a pressure volume enclosed by a shell. Within the shell is a diaphragm or bladder that is depressed by the entry of fluid therein. In the most recent quarter century, to increase the fuel economy of automotive vehicles, most vehicles have had their front end lowered. The lowering of the front end of the vehicle substantially reduces the space available within the engine compartment. Accordingly, it is highly desirable to provide an engine arrangement having an accumulator which does not require additional space within the engine compartment. It is further advantageous to provide an accumulator which does not require the assembly operation of attachment to a vehicle engine. Accumulators have become more desirable due to other features of many automotive engines which require pressurized oil such as hydraulic cam lifters and hydraulically actuated poppet valves.

SUMMARY OF INVENTION

The present invention brings forth an automotive engine arrangement which includes an engine block having a cylindrical combustion chamber. The combustion chamber mounts a piston for reciprocating movement therein. Passageways are provided through the engine block which connect with the combustion chamber. The passageways have valves for controlling flow through the passageways. The valves are operatively associated with a camshaft that is rotatively mounted in the engine block. The camshaft has an internal cavity for receipt of fluids such as engine lubricating oil. A compliance member is provided within the camshaft cavity for pressurizing the lubricating oil within the camshaft cavity.

The camshaft of the present invention is advantageous in that it provides an accumulator with additional volumetric capacity without requiring additional space within the engine compartment or without any assembly to the automotive engine.

Other advantages of the invention will become more apparent to those skilled in the art upon a reading of the following detailed description and reference of the drawings.

DETAILED DESCRIPTION

Figures 2, 5:
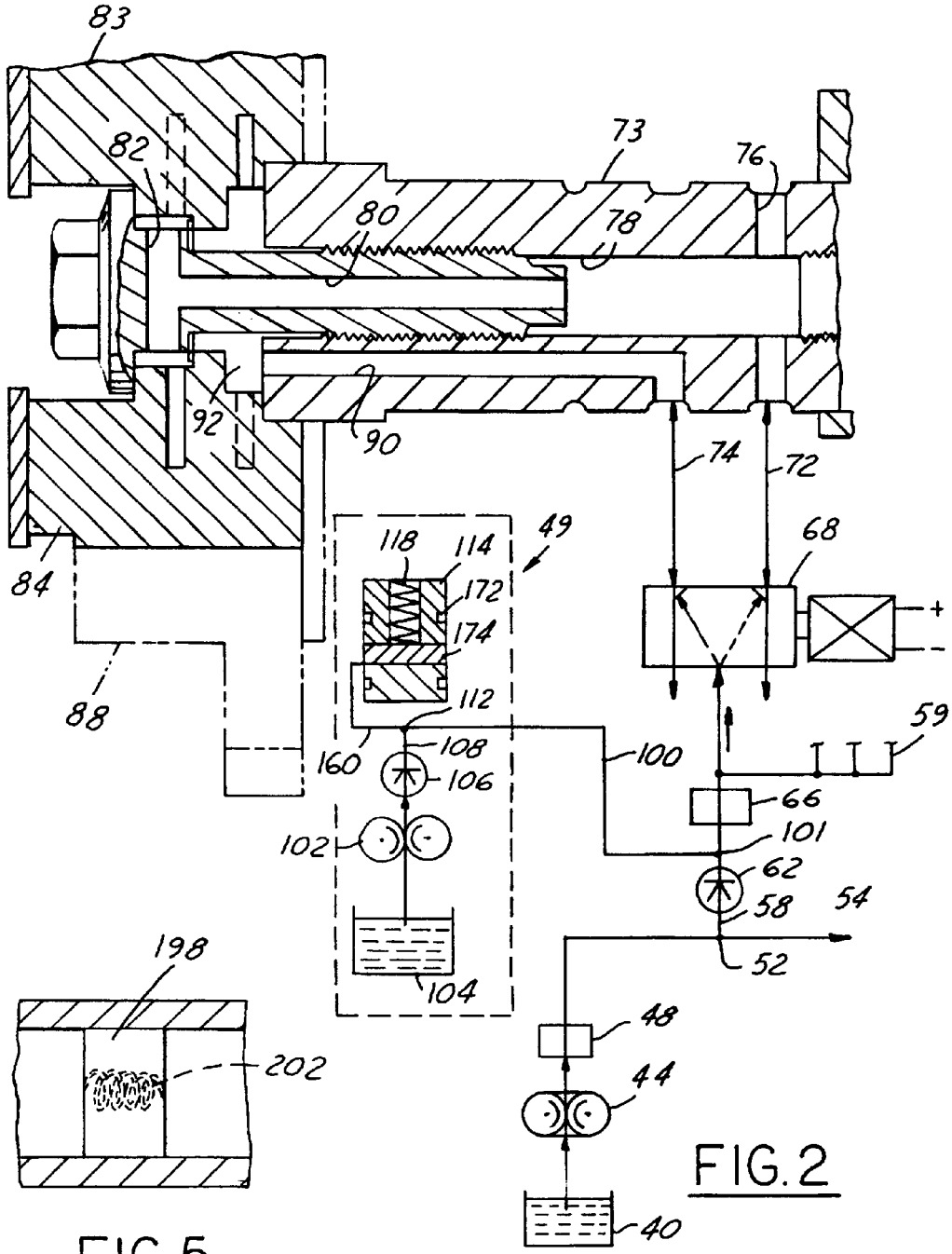
FIG. 2 is a schematic view of an oil supply arrangement which pressurizes a camshaft accumulator for use with the engine shown in FIG. 1.
FIG. 5 is an enlarged view of a stop utilized in the accumulator shown in FIG. 3.
Figure 4:
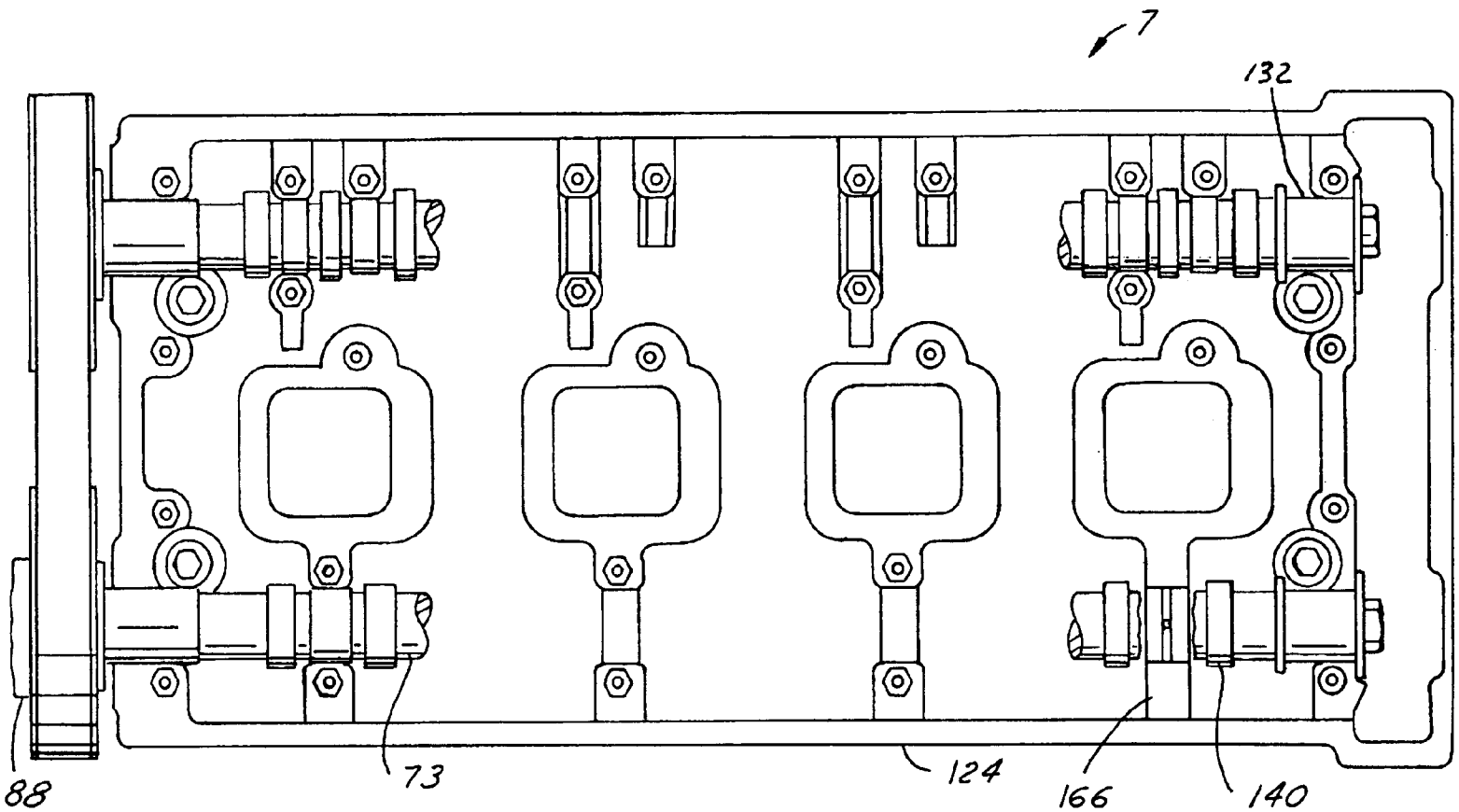
FIG. 4 is a top plan view of the engine shown in FIG. 1 with the cap removed to expose the engine camshafts.

Referring to FIG. 2, a VCT oil supply arrangement 49 has a sump 40. The sump 40 is fluidly connected with a first or main engine oil pump 44. The main engine oil pump 44 in most applications is powered by the engine crankshaft (not shown) and delivers pressurized oil to and through a filter 48. The engine oil pump 44 may alternatively be electrically powered by a motor.

After leaving the filter 48, pressurized oil is then delivered to a T connection 52. At lower engine speeds, virtually all the oil goes through a line 54 to accommodate the various lubrication functions of the engine. Oil is also delivered to a line 58. The line 58 is connected to an intake of a first check valve 62. Oil passing through the check valve 62 passes through a VCT oil filter 66. Oil passing through the filter 66 is delivered to a solenoid valve 68. Oil from the solenoid valve 68 may be delivered or removed into an intake camshaft 73, lines 72 and 74. The line 72 connects to a first passage that includes a cross bore 76, an axial bore 78, VCT fastener bore 80 and a VCT fastener cross bore 82 to pressurize a retard side of a VCT pressure chamber 83, which extends between a VCT hub 84 and a VCT timing pulley unit 88. Alternatively, the solenoid valve 68 may deliver pressurized fluid through a line 74 through a second passage that includes a longitudinal bore 90 which, in turn, connects to a chamber 92 which feeds into an advance side of a pressure chamber between the hub 84, and a VCT pulley unit 88. A more detailed review of the working of the VCT unit can be gained by a review of Diggs, et al., U.S. patent application Ser. No. 09/742,707, filed Dec. 20, 2000 commonly assigned. The line 58 has a T connection 101 with a line 100.

A second smaller oil pump 102 has a suction line connected with a sump 104 that can be separate or combined with the other oil sump 40. The second oil pump 102 can be crankshaft driven or electrically powered by a motor. The second oil pump delivers pressurized fluid through a second check valve 106. The second check valve 106 has an outlet 108 which is fluidly connected with a T connection 112. T connection 112 has one end connected with a line 160. Line 160 connects with an accumulator 114. The accumulator 114 has a coil spring compliance member 118 to pressurize the contents of the accumulator 114. The accumulator 114 can be in a rearward end of a camshaft 73. In alternative embodiments, not shown, the accumulator is positioned in a middle portion or toward a front end of the camshaft 73.

Figure 1:
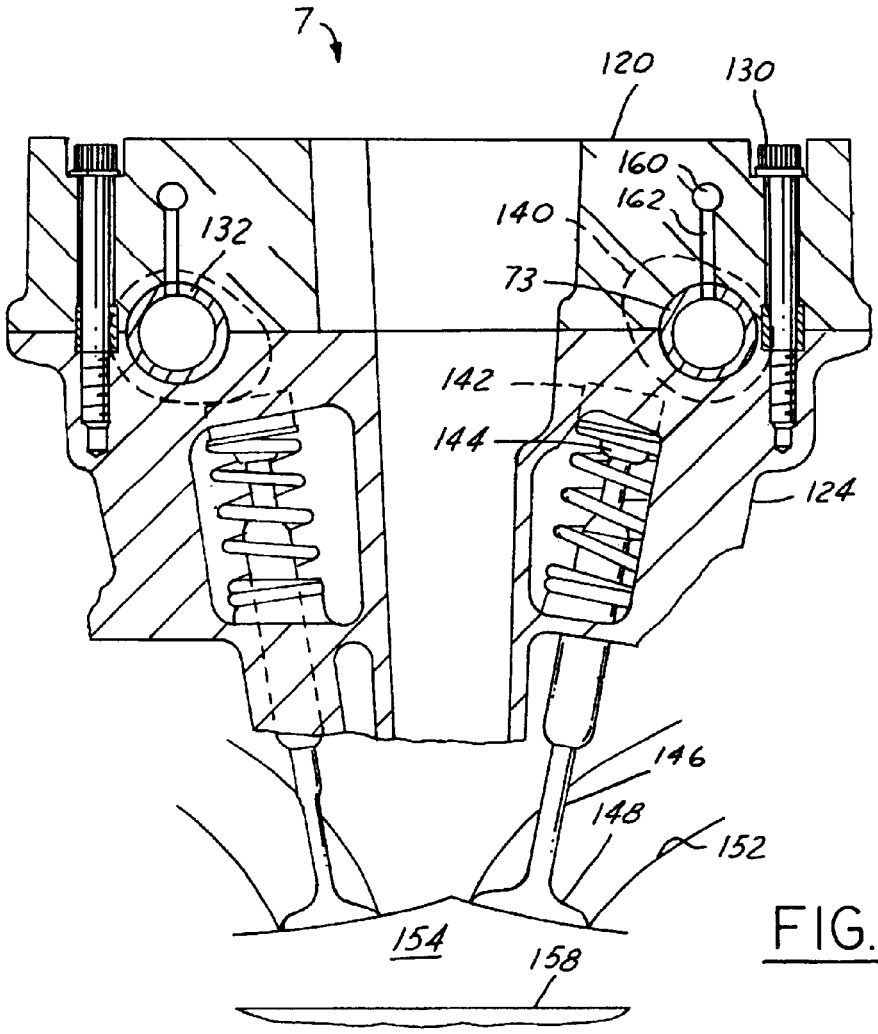
FIG. 1 is a sectional view of an automotive internal combustion engine having a camshaft with an accumulator according to the present invention.

Referring to FIG. 1, the automotive engine arrangement 7 has a body with a cylinder head 124. The cylinder head has a camshaft bearing cap 120. The bearing cap 120 is joined with the cylinder head 124 by a series of cap screws 130. The cylinder head 124 and bearing cap 120 rotatably mount overhead intake and exhaust camshafts 73, 132.

Figure 3:
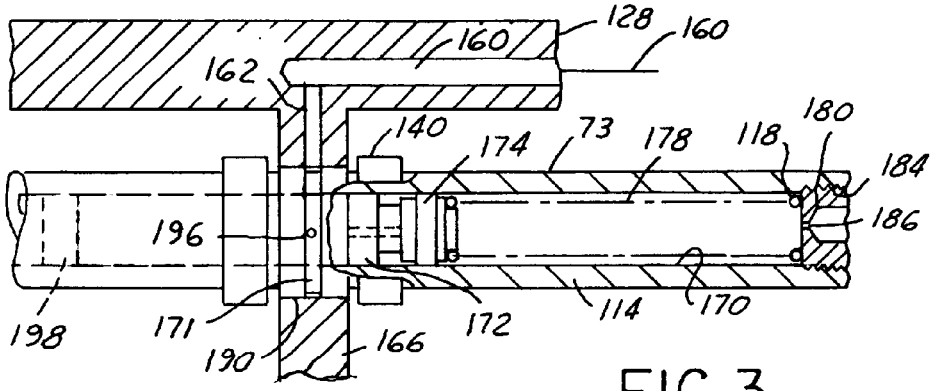
FIG. 3 is a sectional view of the accumulator which is utilized in the engine shown in FIG. 2.

Referring to the intake camshaft 73, a cam lobe 140 is provided for making contact on a tappet 142 (illustrated out of normal position in contact with lobe 140). The tappet 142 is operatively associated with an end 144 of a poppet valve 146. The poppet valve is spring-loaded to a closed position. Rotation of the cam lobe 140 allows the poppet valve 146 to open and close. The poppet valve 146 has a valve head 148. The valve head 148 controls flow through an inlet passageway 152. The inlet passageway 152 receives air from the air induction system of the engine (not shown). A combustion chamber 154 of an engine block of the engine body slidably mounts a reciprocating piston 158. The cap 120 has a pressurized oil line 160. Pressurized oil line 160 has a T connection 162. The T connection 162 extends into camshaft bearing 166 (FIG. 3).

Fitted within the camshaft 73 is the accumulator 114. The accumulator 114 has a rearward internal cavity 170 provided by the internal bore of the camshaft. Press fitted within the bore cavity 170 is a stop 172. The stop 172 provides a limit for a pressure boundary member or the piston 174. The boundary piston 174 is biased by a coil spring 118. The spring 118 provides the compliance to pressurize the accumulated lubricating oil. The spring 118 has a rear end which is set by a core screw 180. Core screw 180 can be turned within a threaded section 184 to set the spring tension on the spring 178. Setting the spring tension adjusts the pressure of the accumulator 114. Screw 180 has a hole 186 to allow for any lubricating oil or entrapped air to exit the camshaft bore cavity 170 rearward (or to the right) of the piston 174. The hole 186 is centrally located to take advantage of the centrifugal effect with air moving to the center while oil moves outwardly.

The camshaft 73 has an enlarged bearing portion 190 which is fitted within the bearing 166. The lower part of bearing 166 is provided integral with the cylinder head 124. The upper portion of the camshaft bearing 166 is provided by an integral portion of the cap 120. The camshaft 73 has an outer annular groove 171. The groove 171 is intersected by a series of geometrically spaced radial bores 196. Seals/rings (not shown) positioned in parallel grooves in the camshaft 73 or the bearing 166 can be provided to laterally seal groove 171.

After leaving check valve 106, fluid from pump 102 goes to T connection 112. T connection 112 connects with line 160. The line 160 connects with the accumulator 114. The accumulator 114 also has the volume within the camshaft 73 on the side of camshaft enlarged portion 190 generally opposite the press fit stop 172. Another press fit or screwed stop 198 provides the second pressure boundary. The stop 198 has an extremely small diameter tortuous path 202 extending therethrough to relieve any entrapped air out of the chamber of the accumulator 114 (FIG. 5), again centrally located to take advantage of the centrifugal effect that moves air to the axis of rotation.

During normal operation, the oil pump 44, which is powered by the crankshaft will have its suction connected with the sump 40. Pressurized oil will be delivered through the filter 48 and proceed to the T connection 52. Assuming the engine's rotational speed is sufficiently high, lubrication oil will be delivered through the remainder of the engine through a lube system through line 54 and pressurized oil will be delivered through the check valve 62 and filter 66 to the solenoid valves 68.

In situations where engine rotational speed is low, the pressure of the oil delivered by the main oil pump 44 will not be sufficiently high to supply the solenoid valve 68 to operate the VCT units. In a V block engine having independently variable inlet and outlet valve trains, line 58 after passing through the filter 66 branches off to three additional lines 59 which have an associated solenoid valve 68 for the other engine VCTs.

If the engine rotational speed is below a given value, an adequate amount of the oil pressurized by the pump 44 will not be able to pass the check valve 62, to enable proper function of the VCT system. The pump 102 can be powered by the crankshaft or by an electric motor (not shown). The pump 102 will deliver pressurized oil past the check-valve 106 into line 108. Pressurized oil in line 108 will then be delivered through line 100 and to T connection 101. Pressurized oil from T connection 101 will enter into line 58 and will be delivered to the solenoid 68 when there is a high volume demand by the various VCT units. Check valve 62 prevents the pump 102 oil flow from entering line 54, thus dedicating the output of pump 102 to the VCT system.

The size of the pump 102 may be minimized due to the availability of the accumulator 114 to provide additional volume when short duration, high volume pressurized oil is needed by the VCT units 83. Depending upon the pressurized fluid demand of the whole system, there can be additional accumulators similar to that of 114 provided in the other camshafts of the engine which can be separately connected with the line 100 or in still another alternative, may be directly connected with an individual filter and a respective line 59. All such accumulators will be fluidly connected with the pump 102 via a check valve arrangement.

If the pump 102 is directly connected to the camshaft, minimizing its size is even more beneficial since parasitic losses can be held to a minimum while still providing a large volume of pressurized oil for the VCT units due to the availability of the accumulator or accumulators 114. During high engine rotational speed, if the pump 102 is torsionally fixed with the crankshaft, then the pressure beyond the check valves 62, 106 will increase. The increased pressure will be trapped by check valves 62, 106, thereby preventing loss of the additional flow and pressure into line 54 of the oil lubrication system as desired.

Although accumulator 114 has been shown in the capacity of use with a VCT system, accumulator 114 can have other uses such as hydraulic cam lifters, hydraulically actuated poppet valves, or in other situations where accumulator systems can be used with internal combustion engines. In most instances, the accumulator 114 will store pressurized lubricating oil, however other fluids may be stored by the accumulator if so desired.

While the invention has been described in conjunction with preferred embodiments, it will be understood that it is not intended to limit the invention to those particular embodiments. On the contrary, it is endeavored to cover all alternatives, modifications and equivalents as may be included within the spirit and scope of the invention as it is encompassed by the description and as defined by the appended claims.

What is claimed is:

1. An automotive engine arrangement comprising:

an engine body having a cylindrical combustion chamber for mounting a reciprocating piston therein;

a passageway through said engine body connected with said combustion chamber;

a valve for controlling flow through said passageway;

a camshaft rotatively mounted by said engine body and adapted to receive a variable camshaft timing unit, said cam shaft having a lobe operatively associated with said valve for operating the same; and an accumulator located in an internal cavity of said camshaft for receipt of engine lubricating oil, wherein said accumulator has a compliance member for pressurizing said lubricating oil for use with the variable camshaft timing unit.

2. An engine arrangement as described in claim 1, wherein said compliance member includes a spring-biased pressure boundary.

3. An engine arrangement as described in claim 2, wherein a stop is fitted within said camshaft cavity and said pressure boundary is position limited by said stop.

4. An engine arrangement as described in claim 2, wherein said camshaft has a core screw to set a tension on said spring.

5. An engine arrangement as described in claim 4, wherein said core screw has a hole to allow for escape of lubricating oil or entrapped air from said camshaft cavity rearward of said pressure boundary.

6. An engine arrangement as described in claim 1, wherein said camshaft has a radial bore intersecting said cavity for delivery of lubricating oil into said cavity.

7. An engine arrangement as described in claim 6, wherein a bearing support encircles said camshaft adjacent said radial bore.

8. An engine arrangement as described in claim 6, wherein said camshaft has an annular groove for fluid communication with said radial bore in said camshaft.

9. An engine arrangement as described in claim 1, wherein said camshaft is an overhead camshaft.

10. An engine arrangement as described in claim 1, wherein said cavity has a bleed hole.

11. An engine arrangement as described in claim 10, wherein said bleed hole is provided by a tortuous path.

12. An engine arrangement as described in claim 10, wherein said bleed hole is centrally located.

* * * * *